US011370567B2

(12) United States Patent
Le Dimet et al.

(10) Patent No.: US 11,370,567 B2
(45) Date of Patent: Jun. 28, 2022

(54) DEVICE FOR VACUUM AND VENT TUBE STOPPERING A MEDICAL CONTAINER

(71) Applicant: Becton Dickinson France, Le Pont de Claix (FR)

(72) Inventors: Gwenn Le Dimet, Charavines (FR); Julien Gagliano, Grenoble (FR)

(73) Assignee: Becton Dickinson France, Le Pont de Claix (FR)

( * ) Notice: Subject to any disclaimer, the term of this patent is extended or adjusted under 35 U.S.C. 154(b) by 373 days.

(21) Appl. No.: 16/630,295

(22) PCT Filed: Jul. 11, 2018

(86) PCT No.: PCT/EP2018/068736
§ 371 (c)(1),
(2) Date: Jan. 10, 2020

(87) PCT Pub. No.: WO2019/011960
PCT Pub. Date: Jan. 17, 2019

(65) Prior Publication Data

US 2020/0163841 A1 May 28, 2020

(30) Foreign Application Priority Data

Jul. 11, 2017 (EP) ..... 17305913

(51) Int. Cl.
*B65B 7/28* (2006.01)
*A61J 1/20* (2006.01)
(Continued)

(52) U.S. Cl.
CPC ..... *B65B 7/2821* (2013.01); *A61J 1/2041* (2015.05); *A61J 1/2072* (2015.05); *A61J 1/2096* (2013.01);
(Continued)

(58) Field of Classification Search
CPC ..... A61J 1/20; A61J 1/2072; A61J 1/2041; A61J 1/2096; A61J 2200/70; B65B 7/161;
(Continued)

(56) References Cited

U.S. PATENT DOCUMENTS 3,824,762 A * 7/1974 Walles ..... B65B 31/044 53/88
4,186,542 A * 2/1980 Oyagi ..... B67B 1/04 53/88
(Continued)

FOREIGN PATENT DOCUMENTS

GB 801918 9/1958
GB 2322851 A 9/1998
(Continued)

*Primary Examiner* — Nicolas A Arnett
(74) *Attorney, Agent, or Firm* — The Webb Law Firm

(57) ABSTRACT

The present invention relates to a device for vacuum and vent tube stoppering a medical container. The device includes a main body defining an internal volume that has a first variable pressure chamber configured to be connected to a vacuum pump, the main body being configured to receive the proximal end of a medical container so that said medical container is in communication with the first variable pressure chamber. A vent device including a vent tube is moveable inside the internal volume of the main body along a longitudinal axis between a proximal rest position and a distal operative position. A piston rod is moveable inside the internal volume of the vent tube along the longitudinal axis between a proximal rest position and a distal operative position. A container holder system is provided in the main body, in communication with the first variable pressure chamber.

14 Claims, 7 Drawing Sheets

(51) Int. Cl.

| | |
|---|---|
| ***B65B 31/02*** | (2006.01) |
| ***B65B 67/02*** | (2006.01) |
| ***B65B 7/16*** | (2006.01) |
| ***B65B 31/04*** | (2006.01) |

(52) U.S. Cl.
CPC ..... *B65B 7/161* (2013.01); *B65B 31/027* (2013.01); *B65B 31/046* (2013.01); *B65B 67/02* (2013.01); *A61J 2200/70* (2013.01)

(58) Field of Classification Search
CPC ... B65B 7/2821; B65B 31/027; B65B 31/046; B65B 67/02
See application file for complete search history.

(56) References Cited

U.S. PATENT DOCUMENTS

| | | | | |
|---|---|---|---|---|
| 4,848,419 | A * | 7/1989 | Damen | B65B 31/046 141/59 |
| 6,223,408 | B1 * | 5/2001 | Vetter | B65B 7/2821 29/234 |
| 8,726,615 | B2 * | 5/2014 | Desrues | B65B 31/025 53/410 |
| 10,266,293 | B1 * | 4/2019 | Russell | B65B 31/027 |
| 2006/0168916 | A1 * | 8/2006 | Griebel | B65B 3/003 53/489 |
| 2007/0175538 | A1 * | 8/2007 | Rothbauer | B65B 3/003 141/59 |
| 2015/0190578 | A1 * | 7/2015 | Okihara | B65B 7/2821 53/111 R |
| 2016/0136048 | A1 * | 5/2016 | Marantis | A61M 1/0003 141/331 |
| 2019/0382143 | A1 * | 12/2019 | Verma | B65B 59/001 |
| 2020/0163841 | A1 * | 5/2020 | Le Dimet | A61J 1/2041 |
| 2020/0268974 | A1 * | 8/2020 | Le Dimet | B65B 7/161 |

FOREIGN PATENT DOCUMENTS

| | | | |
|---|---|---|---|
| JP | H1147275 | A | 2/1999 |
| JP | 2005204678 | A | 8/2005 |
| KR | 101617853 | B1 | 5/2016 |

* cited by examiner

DEVICE FOR VACUUM AND VENT TUBE STOPPERING A MEDICAL CONTAINER

CROSS-REFERENCE TO RELATED APPLICATIONS

This application is the United States national phase of International Application No. PCT/EP2018/068736 filed Jul. 11, 2018, and claims priority to European Patent Application No. 17305913.0 filed Jul. 11, 2017, the disclosures of which are hereby incorporated by reference in their entirety.

BACKGROUND OF THE INVENTION

Field of the Invention

The invention relates to a device for vacuum and vent tube stoppering a medical container as a syringe or the like, a system for vacuum and vent tube stoppering a medical container comprising such a device, and a method for vacuum and vent tube stoppering a medical container with such a device or system.

Description of Related Art

Prefilled injection devices are common containers to deliver drugs or vaccines to patients and include syringes, cartridges and autoinjectors or the like. They usually comprise a sealing stopper in gliding engagement into a container, the container being filled with a pharmaceutical composition in order to provide the practitioners with a ready-to-use injection device for patients.

A container has a substantially cylindrical shape, and comprises a proximal end able to be stoppered by a sealing stopper, a distal end wherein the pharmaceutical composition is expelled from the container, and a lateral wall extending between the proximal end and the distal end of the container. In practice, the sealing stopper is aimed at moving, upon the pressure exerted by a plunger rod, from a proximal end of the container body towards the distal end of the container body, thereby expelling the drug contained into the container body.

When compared to empty injection devices that are filled with a vial-stored pharmaceutical composition just prior to the injection to the patient's body, the use of prefilled injection devices leads to several advantages. In particular, by limiting the preparation prior to the injection, the prefilled injection devices provide a reduction of medical dosing errors, a minimized risk of microbial contamination and an enhanced convenience of use for the practitioners. Furthermore, such prefilled containers may encourage and simplify self-administration by the patients which allows reducing the cost of therapy and increasing the patient adherence. Finally, prefilled injection devices reduce loss of valuable pharmaceutical composition that usually occurs when a pharmaceutical composition is transferred from a vial to a non-prefilled injection device. This results in a greater number of possible injections for a given manufacturing batch of pharmaceutical product thus reducing buying and supply chain costs.

Prefilled injection devices are usually obtained by filling an empty medical container with a desired pharmaceutical composition, then stoppering the filled container under vacuum or by vent tube or a combination of both.

The term "vacuum" used herein means a low pressure, far inferior to the atmospheric pressure of 1013.25 hectoPascal (hPa) (equals to 1.013 bar), and preferably close to 0 hPa.

A filled container is generally stoppered right after filing of the drug into the container body using stoppering machines according to the following method: the medical container to be stoppered is positioned on an adapted support (for example, in a nest or clipped directly on the stoppering machine), with its proximal end up, that is with its distal end down and maintained in this position.

In the case of vent tube stoppering, the stopper is compressed in a tube, usually called "vent tube", which outer diameter is smaller than the inner diameter of the container, so as to allow air circulation between the vent tube and the container before the stopper is positioned into the container.

In the case of combining vacuum stoppering and vent tube stoppering techniques, the stopper is compressed in a tube which outer diameter is smaller than the inner diameter of the medical container, which allows the insertion of the tube inside the container. A suction cup in communication with a variable pressure chamber is then positioned onto the distal end of the container so as to close it in a tight manner. At this time, the pressure inside the variable pressure chamber and the pressure in the portion of the medical container above the composition and in the tube are both substantially equal to the atmospheric pressure $P_0$.

The variable pressure chamber is connected to a vacuum pump or the like and placed under vacuum. As a result, the portion of the medical container above the composition and the inner volume of the tube are both under vacuum, at a pressure $P_1$, inferior to the initial pressure $P_0$. A sealing stopper, previously positioned inside the tube, is then moved by a piston rod towards the proximal end of the container above the composition. The breaking of the vacuum inside the variable pressure chamber then causes the stopper to move further down the medical container until equilibrium of pressure: the medical container is then stoppered.

Compared to the vacuum stoppering technique, this technique combining vacuum stoppering and vent tube stoppering allows decreasing the air column to be compressed by the pressure differential, resulting in an air bubble of a minimum size. This is particularly true for small filling volumes in large containers.

Indeed, the use of a vent tube allows for positioning the stopper much closer to the surface of the composition compared to the general vacuum stoppering method, because the vent tube can enter the medical container such that the distal end of the vent tube is very close to the surface of the composition. Hence, after the piston rod pushes the stopper out of the vent tube, inside the medical container, the distance to be traveled by the stopper up to the surface of the composition, when breaking the vacuum, is reduced. The remaining air bubble inside the stoppered container is thus further reduced.

However, this method is carried out using large and heavy machines thus implying the following drawbacks.

Lab scale machines that are commonly used in this field cannot be sterilized. Indeed, these machines are not easily movable by an operator and cannot be placed in an autoclave due to their dimensions, weight and design. They also include electrical and electronic parts that are not autoclavable.

Moreover, as the process of vacuum and vent tube stoppering medical containers is generally carried out in clean rooms to ensure the sterility of the medical containers, the corresponding equipment has to be placed in the clean rooms as well.

The performance of quick and simple implementation of vacuum and vent tube stoppering of a medical container, which do not necessarily require to be carried out in sterile conditions, thus have to be carried out in a clean room anyway, as the machines cannot be moved from said clean rooms. For example, small scale aseptic filling can be carried out in reduced sterile environment such as under laminar flow hood. Such small environment does not allow the placement of heavy stoppering equipment due to their dimensions, weight, and the fact that they cannot be sterilized.

Yet operating in a clean room is very constraining for an operator, who has to get dressed accordingly and observe strict and specific work procedures, thus renders implementation of the vacuum stoppering much longer and demanding to carry out.

As a consequence, there is a strong need for a device for stoppering a medical container with the combination of vacuum and vent tube stoppering techniques that is, at the same time, sterilizable and easily and rapidly movable from one place to another so as to be used with no restriction of area, and that can be used outside clean rooms.

In addition, there is also a need for a device that is easy to use, allowing the performance of quick and simple implementation of vacuum and vent tube stoppering of a medical container, in particular prior to a clinical trial involving the use of an injection device comprising such a medical container.

SUMMARY OF THE INVENTION

An object of the invention is thus to provide a device that combines vacuum and vent tube techniques for stoppering a medical container that overcomes the drawbacks of the known devices.

Such an improved device is sterilizable and easily and rapidly movable, and can be used with no restriction of area.

The device allows the performance of quick and simple implementation of vacuum and vent tube stoppering of a medical container, for instance, prior to a clinical trial involving the use of an injection device comprising such a medical container.

One object of the invention is a device for vacuum and vent tube stoppering a medical container, comprising:

a main body defining an internal volume that comprises a first variable pressure chamber configured to be connected to a vacuum pump, the main body being configured to receive the proximal end of a medical container so that said medical container is in communication with the first variable pressure chamber and,

- a vent device comprising a vent tube moveable inside the internal volume of the main body along a longitudinal axis between a proximal rest position and a distal operative position wherein the vent tube passes through the first variable pressure chamber down to the inside of the medical container, the vent tube having an internal volume configured to contain a stopper in a compressed state, the vent tube being in communication with a second variable pressure chamber configured to be connected to the vacuum pump,
- a piston rod moveable inside the internal volume of the vent tube along the longitudinal axis between a proximal rest position and a distal operative position wherein the piston rod pushes the stopper into the medical container when the vent tube is in the operative position,
- a container holder system provided in the main body, in communication with the first variable pressure chamber, said container holder system being configured to receive the proximal end of a medical container to be stoppered and to hold the medical container aligned with the direction of travel of the vent tube so that when moving from the proximal rest position to the distal operative position, the vent tube enters the medical container.

In this application, the "distal direction" is to be understood as meaning the direction of introduction of the stopper into the medical container, and the "proximal direction" is to be understood as meaning the opposite direction to said direction of introduction of the stopper into the medical container.

According to other optional features of the device of the invention:

- the vent tube comprises a shoulder between a first portion moveable inside the internal volume of the main body, and a second portion configured to abut the proximal end of the main body when the vent tube is in the operative position;
- the inner volume of the vent tube is configured to compress radially the stopper inserted herein so that the stopper has a reduced diameter compared to the diameter of the stopper when positioned inside the medical container;
- the vent device comprises a leak tight lid from which extends the vent tube along the longitudinal axis, the leak tight lid defining an internal volume that comprises the second variable pressure chamber;
- the leak tight lid comprises an aperture on its proximal end, the aperture being aligned with the longitudinal axis and configured for receiving both the stopper and the piston rod to be inserted in the vent tube;
- the main body comprises a first portion including a spacer configured to guide the vent tube along the longitudinal axis, and a second portion distally adjacent to the first portion, including the first variable pressure chamber;
- the main body comprises a container holder system arranged in communication with the first variable pressure chamber and configured to receive the proximal end of a medical container, the container holder system comprising:
  - a proximal wall provided with an opening in communication with the variable pressure chamber, the opening being aligned with the axis of the piston rod and configured so that, when moving, the vent tube passes through the opening,
  - a distal wall facing the proximal wall and joined to the proximal wall by a lateral wall provided with a slot, the distal wall being provided with a through groove continuous with the slot and extending in the distal wall from the slot, the proximal wall, the distal wall, and the lateral wall defining a housing in-between able to receive the end of the medical container inserted through the slot and moved along the groove to be aligned with the direction of travel of the vent device;
- the proximal wall of the container holder system comprises a recess provided with the opening, the recess being configured to contact the proximal end of the medical container and to block the medical container radially when the latter is positioned in the housing and when the device is under vacuum;
- the piston rod comprises a handle so as to be moved manually by a user;
- the device is handheld, i.e. can be carried in one hand of a user during use and transport from one location to another. The dimensions and the weight of the device are advantageously adapted for this purpose.

Another object of the invention is a system for combining vacuum and vent tube techniques for stoppering a medical container comprising a device as described above. According to a preferred embodiment, the system comprises a vacuum pump and a vacuum valve for pulling vacuum and adjusting the pressure in the first and second variable pressure chambers of the device to a pressure inferior to the atmospheric pressure, and a back valve for breaking vacuum so as to adjust the pressure in the first and second variable pressure chambers back to the atmospheric pressure. Advantageously, the system further comprises a digital display associated with a probe positioned inside each of the first and second variable pressure chambers so as so measure and display the pressure in said first and second variable pressure chambers to an operator.

Another object of the invention is a method for combining vacuum and vent tube techniques for stoppering a medical container using a device or a system as described above, comprising:

a) Positioning a stopper inside the vent tube;
b) Mounting a medical container pre-filled with a composition on the main body of the device;
c) Pulling vacuum in the first and second variable pressure chambers so as to decrease the pressure inside the first and second variable pressure chambers and inside the vent tube;
d) When the pressure is down to a desired level, moving the vent tube along the longitudinal axis through the main body, up to the inside of the medical container, and moving the piston rod along the vent tube so as to push the stopper out of the vent tube and position said stopper inside the medical container;
e) Breaking the vacuum so as to increase the pressure inside the first and second variable pressure chambers, causing the stopper to move further down the medical container to the surface of the composition contained herein due to pressure differential between the first and second variable pressure chambers and the remaining volume between the stopper and the composition.

Preferably, the device is held in a user's hand, and at least elements a), b), and d) are carried out manually by the user.

BRIEF DESCRIPTION OF THE DRAWINGS

Further features and advantages of the invention will become apparent from the detailed description to follow, with reference to the appended drawings, in which.

DESCRIPTION OF THE INVENTION

The invention proposes a device 1 combining vacuum stoppering and vent tube stoppering techniques for stoppering a medical container 27, said device being easy to use and to move. In particular, the device can be handled by an operator to perform quick and simple implementation of stoppering of a medical container readily.

Figure 1:
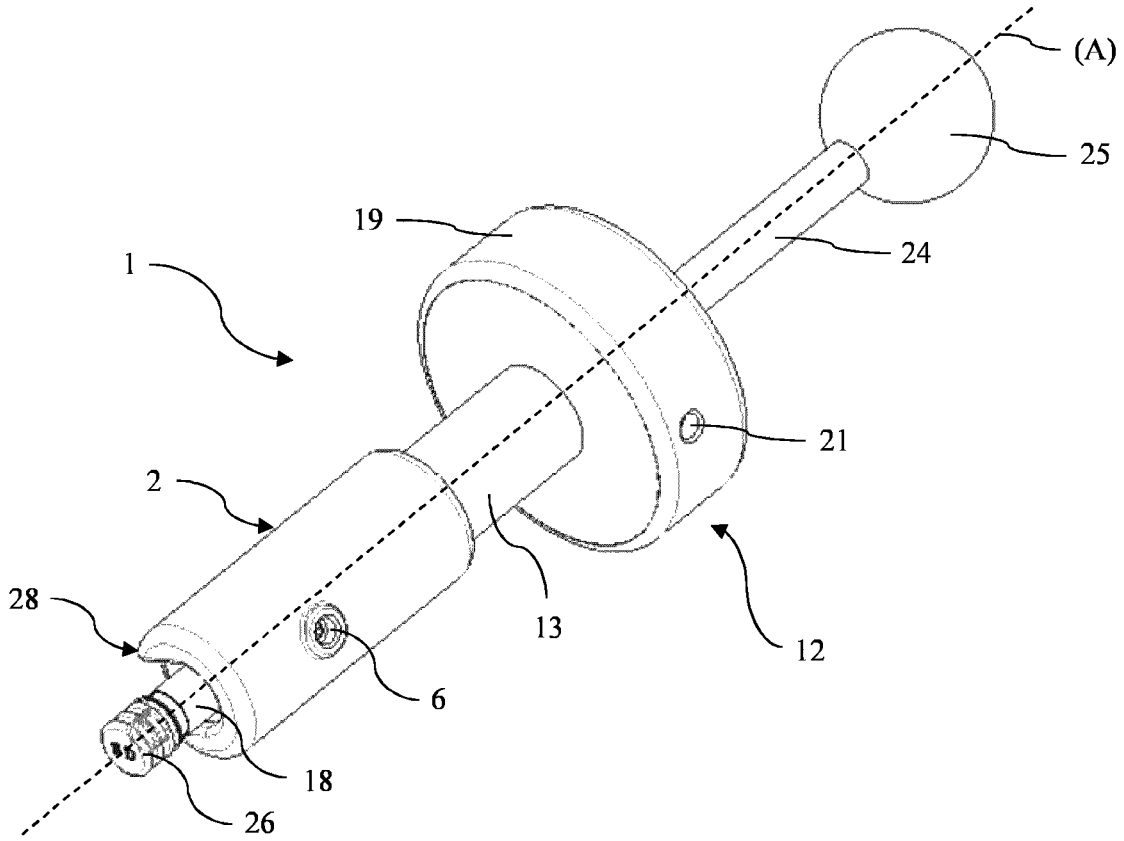
FIG. 1 is a perspective view of an embodiment of the device of the invention.
Figures 2, 2A:
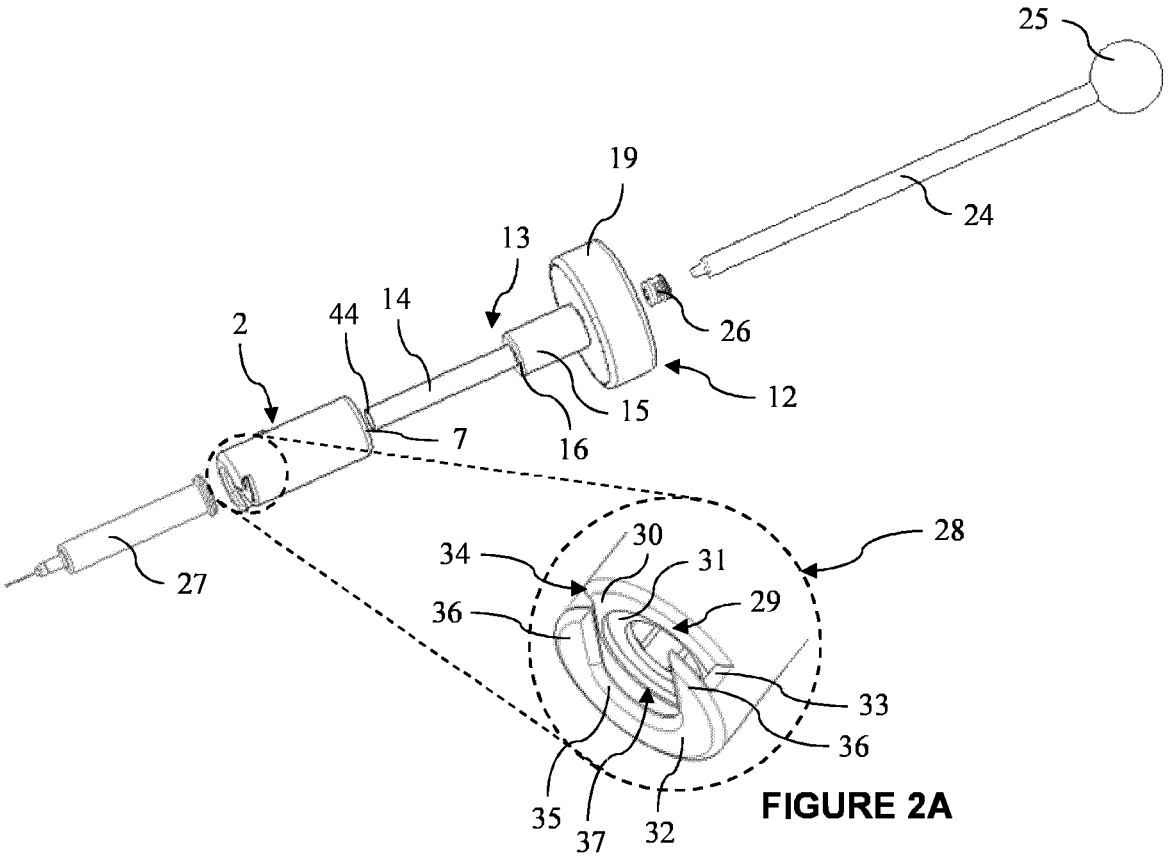
FIG. 2 is an exploded perspective view of the device illustrated in FIG. 1, with a close-up view of an embodiment of a container holder system.

In reference to FIGS. 1 and 2, the device 1 comprises a main body 2, a vent device 12 that comprises a vent tube 13 moveable inside the main body 2 along a longitudinal axis (A), and a piston rod 24 moveable inside the vent tube 13 along the longitudinal axis (A), for positioning a stopper 26 into the medical container 27 to be stoppered.

According to the embodiment of FIGS. 1 and 2, the main body 2 of the device 1 has a substantially cylindrical shape, and comprises a first portion 3 and a second portion 4 distally adjacent to the first portion. Both first and second portions 3, 4 of the main body define an internal volume delimited by their common lateral wall.

Figure 5:
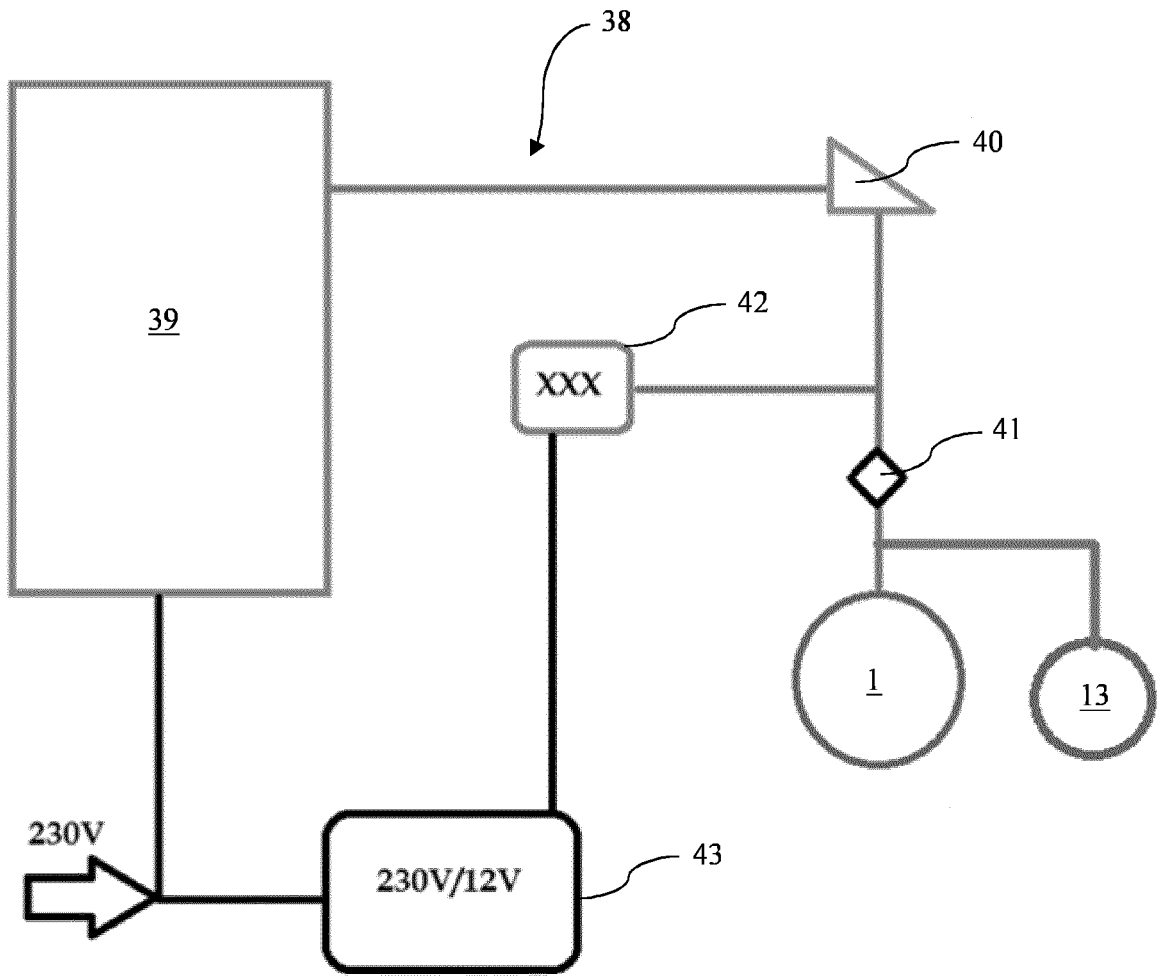
FIG. 5 is a schematic representation of a system comprising the device of the invention.

The main body 2 comprises in the second portion 4, a first variable pressure chamber 5 located inside its internal volume. The first variable pressure chamber 5 is configured to be connected to a vacuum pump 39 (as visible on FIG. 5) or the like via an outlet 6 provided in the corresponding part of the lateral wall of the second portion 4. The pressure inside the first chamber 5 thus can be modified, in particular decreased below the atmospheric pressure so that the first chamber is under vacuum.

The main body 2 also comprises a container holder system 28 located at its distal end and configured to receive the proximal end of the container 27 to be stoppered.

The main body 2 cooperates with the vent device 12 for stoppering a medical container 27. The vent device 12 comprises a vent tube 13 of an elongated shape, preferably of a substantially circular section, that comprises advantageously two portions 14, 15 separated by a shoulder 16 so as to form an abutment, the diameter of the second portion 15 of the vent tube being greater than the diameter of the first portion 14. The first portion 14 of the vent tube is adapted to be inserted into the main body 2 via a first opening 7 provided in the proximal end of the latter, and has for this purpose, a smaller diameter than said first opening of the main body.

The vent tube 13 is configured to receive a stopper 26 intended to be pushed in the inner volume of said vent tube along the axis (A) by the piston rod 24.

The vent tube 13 is guided along the axis (A) by a spacer 10 located in the first portion 3 of the main body 2. The spacer 10 is sealed from both the chamber and the environment by means of radial seal rings 11 positioned at both of its ends.

The device may optionally be provided with an actuator (not represented) for driving the vent tube 13 along the axis (A). The actuator is preferably a pneumatic actuator or an electric actuator, both being quite practical to use, contrary to, for example, a hydraulic actuator which requires a hydraulic system in order to work. The actuator is adapted so that the device can be sterilized and portable, and in particular, so that the device can be used under sterilization conditions such as under a laminar flow hood.

When inserted into the main body 2, the first portion 14 of the vent tube is slidably engaged inside the main body, and is moveable through the first variable pressure chamber 5 along the longitudinal axis (A), and thereby crosses a second opening 8 located between the first and second portions 3, 4 of the main body, and a third opening 9 located at the distal end of the main body.

Figure 3A:
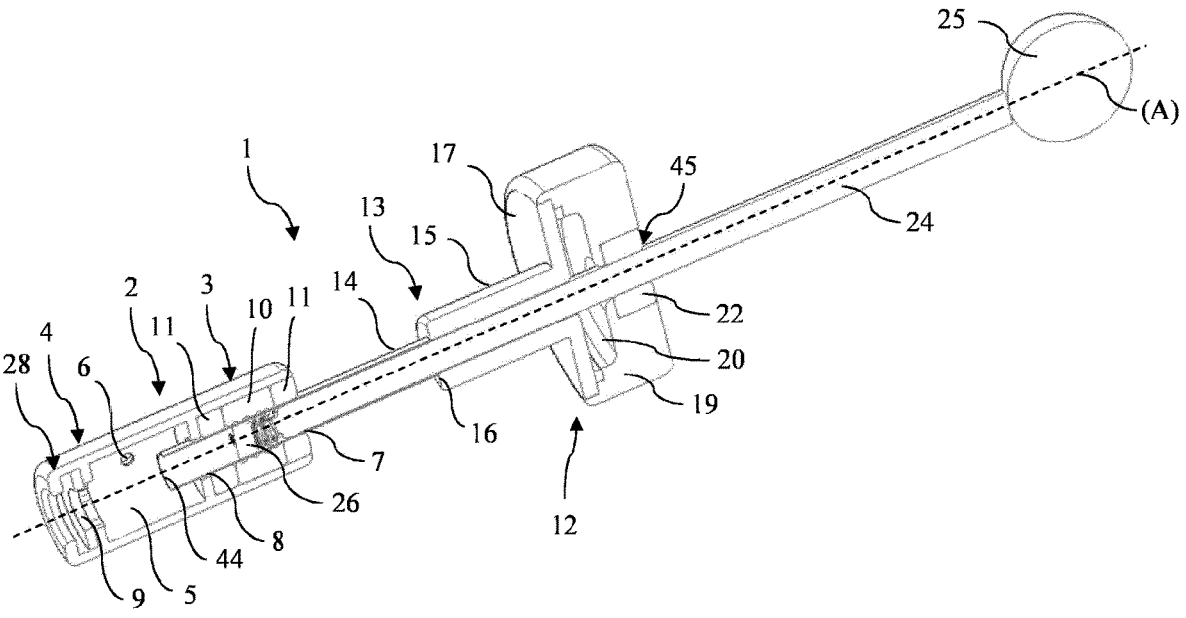
FIG. 3A, 3B, 3C are three cross-sectional perspective views of the device illustrated in FIG. 1, according to different positions of the vent device and the piston rod.
Figure 3B:
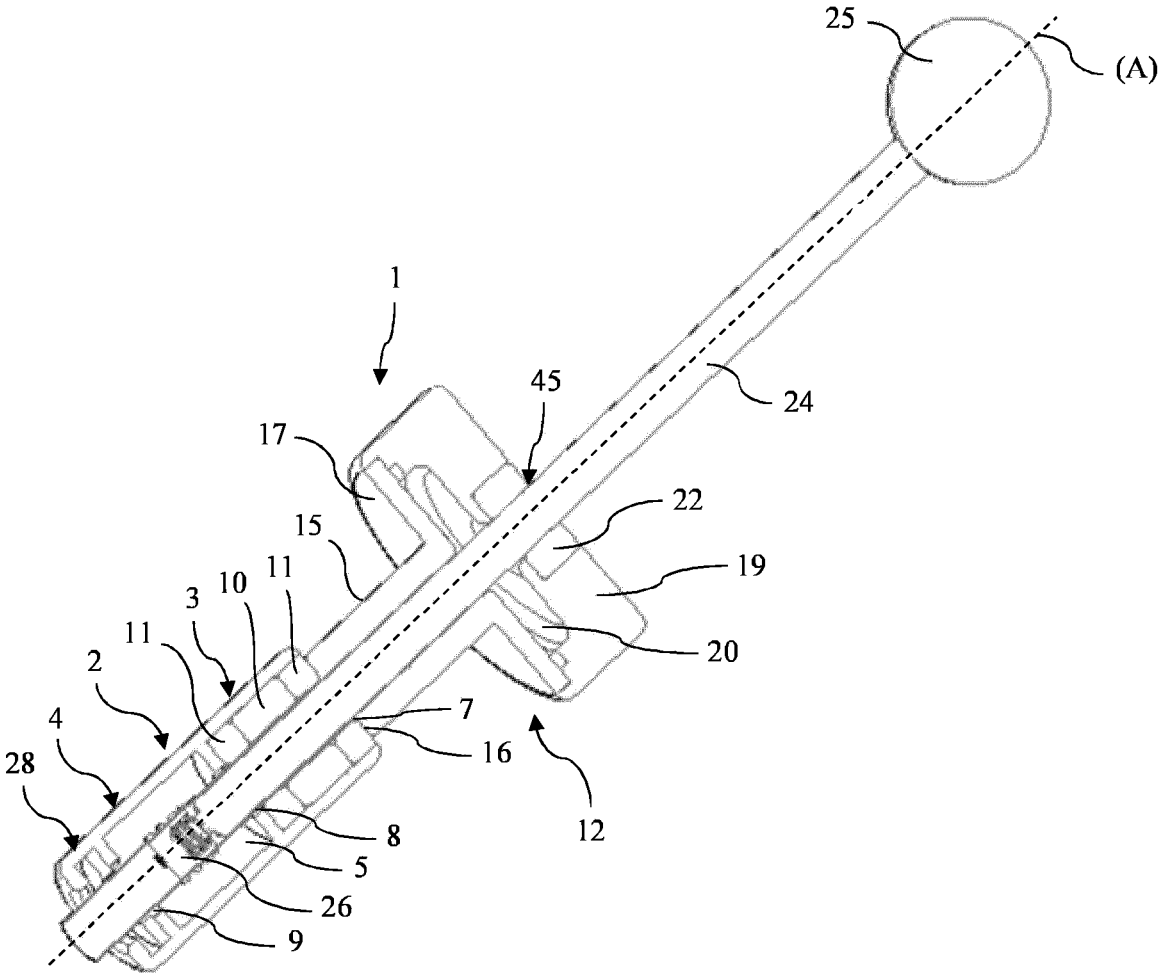
Figure 3C:
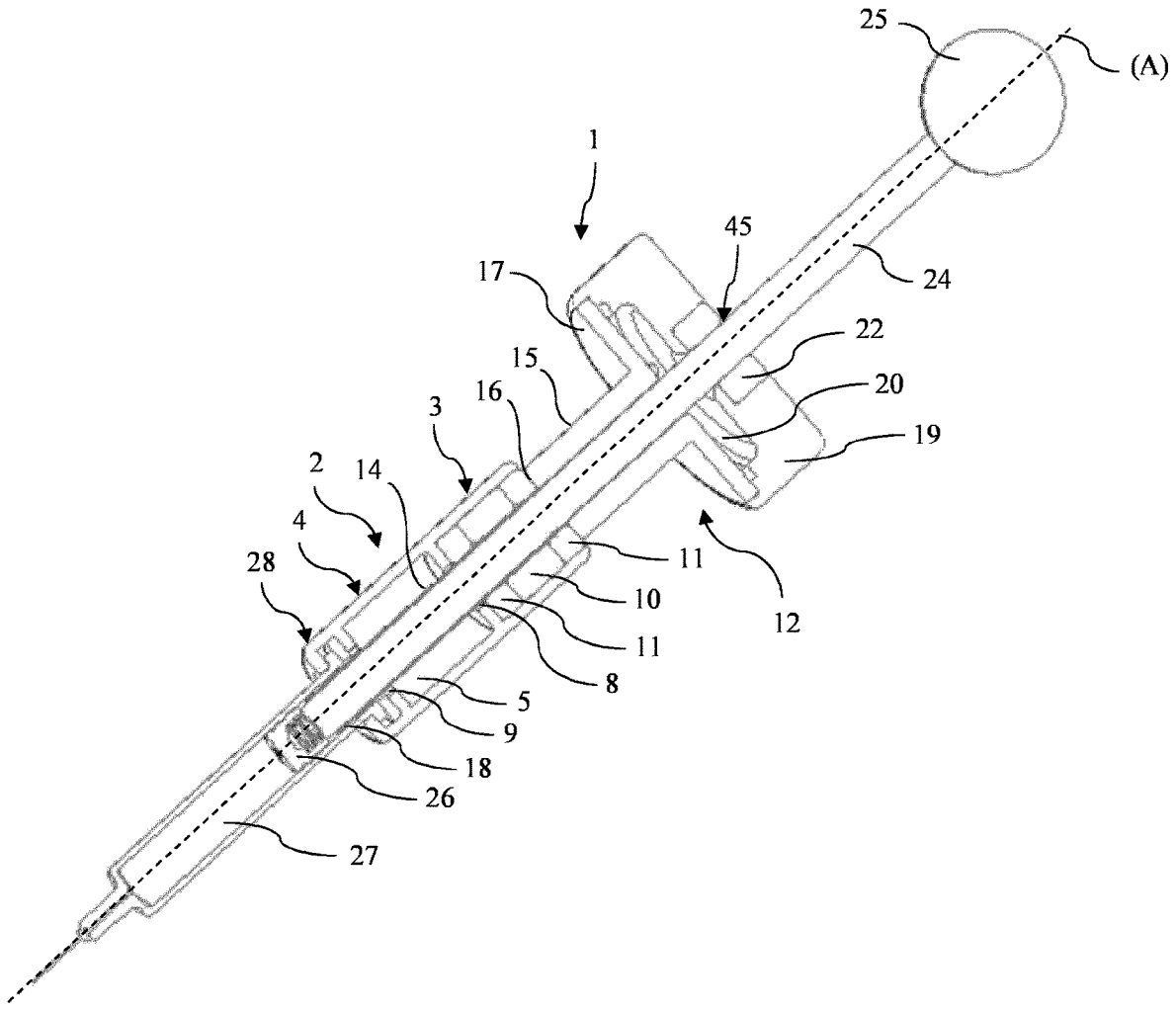

In more details, the vent tube 13 is movable between a proximal rest position illustrated in FIG. 3A wherein the distal end of the vent tube is located in the first chamber 5, in the vicinity of the second opening 8, and a distal operative position illustrated in FIG. 3C wherein the distal end of the vent tube passes through the third opening 9 in the distal end of the main body, via the container holder system 28, and enters the medical container 27 via the proximal end of the latter so as to be relatively close to the surface of the composition contained in said container. The position of the vent tube 13 illustrated in FIG. 3B corresponds to an intermediate position wherein the vent tube is positioned partially inside the medical container 27 in a distance further away from the surface of the composition.

Figure 4:
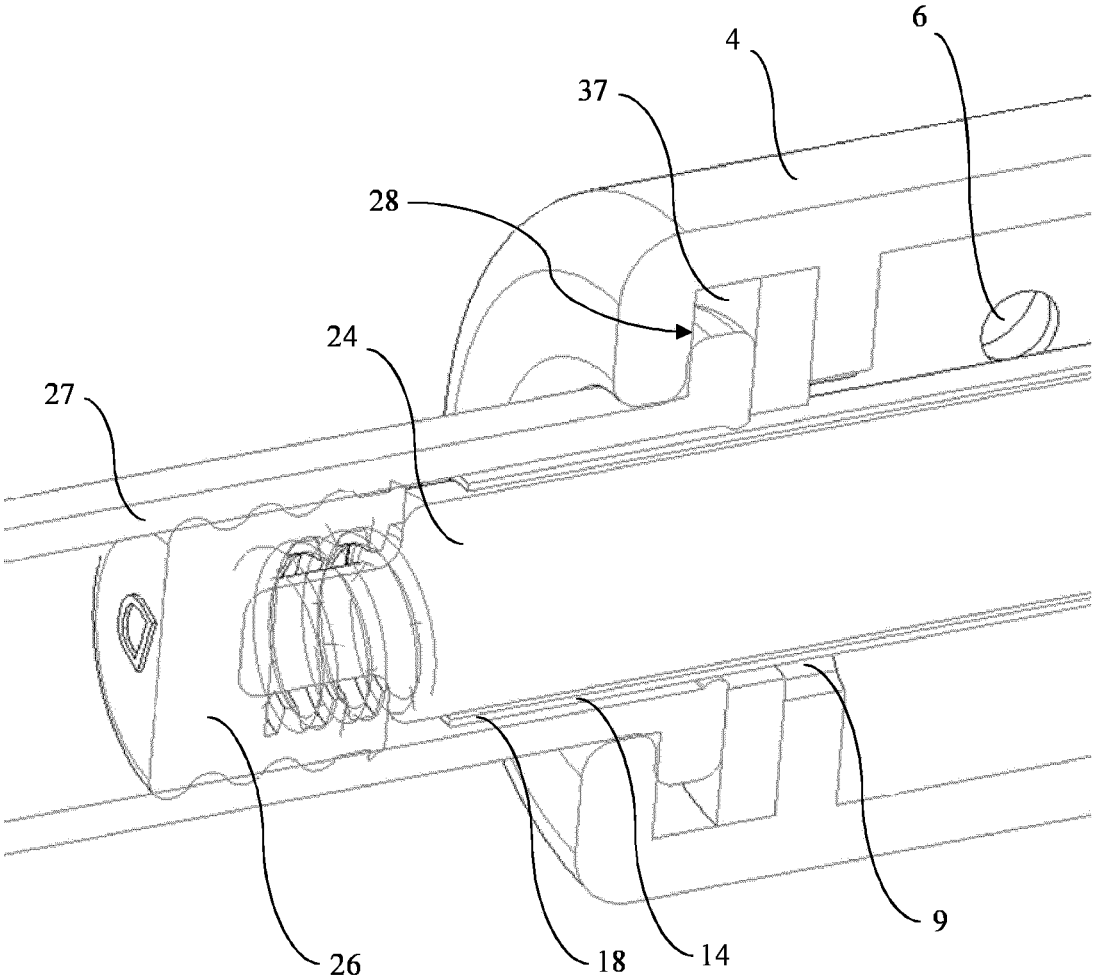
FIG. 4 is a close cross-sectional perspective view of the device illustrated in FIG. 1, centered on the proximal end of the vent device and the piston rod in contact with the stopper.

When the vent device 12 is pushed in the distal direction, the first portion 14 of the vent tube 13 slides inside the main body 2 along the axis (A) until the shoulder 16 between the first and the second portions 14, 15 of the vent tube abuts the proximal end of the main body. The vent tube 13 then cannot slide further towards the main body 2. This position of the vent tube 13 relatively to the main body 2 corresponds to a maximal operative position wherein the distal end of the vent tube is located inside the medical container at a determined position, as illustrated in FIGS. 3 and 4.

In this maximal operative position, the distal end of the vent tube 13 protrudes from the distal end of the main body 2. Yet, for positioning the stopper 26 inside the medical container 27 under vacuum, the vent tube 13 is pushed in the distal direction along the axis (A) to the maximal operative position, then the piston rod 24 is also pushed in the distal direction thereby pushing the stopper 26 out of the vent tube 13 through the distal aperture 44 of the vent tube. Hence, the mechanical positioning of the stopper 26 is determined by the positioning of the distal aperture 44, and thus by the length of the protruding portion 18 of the vent tube 13 in the maximal operative position.

The vacuum stoppering device 1 of the invention aims to stopper a medical container 27 by positioning mechanically and under vacuum the stopper as close as possible to the surface of the composition contained inside the medical container, thanks to the vent device 12 and the piston rod 24, before breaking the vacuum and allow the stopper 26 to travel further down the container 27 up to the surface of the composition, thanks to the vacuum forces. The more the stopper 26 is positioned mechanically close to the surface of the composition, the less the distance the stopper has to travel when breaking the vacuum, for a determined pressure differential $\Delta P$ (difference between the pressure $P_0$, typically atmospheric pressure of the environment surrounding the medical container 27, and the pressure $P_1$ inside the device after mechanical positioning of the stopper under vacuum)). The "air column" between the stopper 26 and the surface of the composition is then reduced, which leads to a corresponding reduction of the size of the air bubble when the medical container 27 is stoppered.

Therefore, the length of the protruding portion 18, and thus the position of the distal opening 44, of the vent tube 13 in the maximal operative position relatively to the main body 2, has to be carefully adjusted so as to position mechanically under vacuum the stopper 26 as close as possible from the surface of the composition, and to reduce to a minimum the size of the air bubble resulting from the stoppering of the medical container.

The positioning of the protruding portion 18 is related to the positioning of the shoulder 16 along the vent tube 13, and by extension, to the length of the first portion 14 of the vent tube and the length of the main body 2. Therefore, these structural and dimensional features also have to be adjusted accordingly in order to achieve the results explained above.

The vent device 12 further comprises a leak tight lid 19, the vent tube 13 being attached to the lid 19 and extending longitudinally from thereon along the axis (A). The lid comprises an internal volume including a second variable pressure chamber 20 in communication with the internal volume of the vent tube 13, and ensures the sealing between the device and the environment.

The second variable pressure chamber 20 allows for pulling vacuum mainly in the internal volume of the vent tube 13, while the first variable pressure chamber 5 allows for pulling vacuum mainly in the main body 2. The presence of the two pressure chambers in different locations of the device 1 and in communication with each other allows for balancing the pressure variation inside the device. Hence, when pulling or breaking the vacuum, the pressure goes down or up rapidly to a desired value in the entire volume of both the vent tube 13 and the main body 2.

According to the embodiment of the device illustrated in FIGS. 1 to 3C, the vent device 12 is in two separable parts, the first part being the vent tube 13 and the second part being the lid 19. The proximal end of the vent tube 13 includes a flange 17 that extends radially outwardly relative to the axis (A), adapted to receive the lid 19 mounted thereon thereby closing the second variable pressure chamber 20, The stopper 26 is advantageously introduced inside the vent tube 13 via an aperture 45 provided in the flange 17 aligned with said vent tube 13 (and thus aligned with the axis (A)), before closing the second variable chamber 20 with the lid 19.

The piston rod 24 is configured to be inserted in the vent device 13, advantageously via a sealed aperture 22 located in the proximal end of the lid 19, aligned with the axis (A), thereby crossing the second variable pressure chamber 20 and the aperture 45 of the flange 17.

The piston rod 24 is then slidably engaged inside the vent tube 13 and movable along the axis (A) relatively to the vent tube, both in a proximal and in a distal direction. To do so, the outer diameter of the piston rod 24 is smaller than the inner diameter of the vent tube 13.

After the vent tube 13 with the stopper 26 therein is pushed in the distal direction up to the maximal operative position, the piston rod 24 is pushed also in the distal direction, from a proximal rest position, to a distal operative position wherein the piston rod pushes the stopper 26 out of the vent tube 13 via the distal opening of the vent tube, up to the inside of the medical container 27 via the proximal end of the medical container.

As a result, the stopper 26 is mechanically positioned in the container 27 at a determined distance of the surface of the composition contained herein, and passes from a contracted state wherein said stopper 26 is pressed radially against the inner surface of the vent tube 13 and has a reduced diameter, to a loosened state wherein said stopper expands radially and contacts the inner surface of the medical container 27.

To allow the positioning of the stopper 26 in the container 27, the length of the piston rod 24 is longer than the length of the vent device 12, in particular longer than the length of the vent tube 13, and adapted so that the distal end of the piston rod 24 sufficiently protrudes from the distal end of the vent tube for pushing the stopper 26 in a desired position into the medical container 27.

After the stopper 26 is positioned in the medical container 27, the vacuum is broken in both the medical container and the vacuum device 1, causing the stopper to move further down the medical container until equilibrium of pressure, up to the surface of the composition: the medical container 27 is then stoppered.

The main body 2 comprises a container holder system 28 configured to receive the proximal end of the container 27 to be stoppered. The container holder system 28 is located at the distal end of the main body 2, and is configured to maintain the container 27 in a position substantially aligned with the axis (A) of travel of both the vent tube 13 and the piston rod 24, so that when moving in a distal direction, the vent tube 13 passes through the container holder system 28 up to the inside of the medical container, and the piston rod 24 also passes through the container holder system 28 while sliding inside the vent tube 13 and pushing the stopper 26 into the medical container 27.

According to the embodiment of FIGS. 1 to 4, the container holder system 28 is located at the distal part of the second portion 4 of the main body.

As best shown on the close-up view of FIG. 2, the container holder system 28 comprises a proximal wall 29, a distal wall 32 that faces the proximal wall, and a lateral wall 33 joining the proximal and distal walls. The proximal wall 29, the distal wall 32, and the lateral wall 33 define a housing 37 configured to receive the proximal end of the container 27 to be stoppered.

The container holder system 28 allows for maintaining the container 27 inserted herein in a fixed position, as well as securing the container by preventing it from falling off from the device 1 while the stopper is being positioned into the container.

According to the embodiment of FIG. 2, the proximal wall 29 comprises a border 30 that surrounds a recess 31, said recess corresponding to the distal end of the second portion 4 of the main body 2. A seal or suction cup (not represented on the Figures) is positioned in the recess 31, so as to extend between the third opening 9 and the border 30. The seal avoids any air leak between the device and the environment, and can be made of any adapted material such as rubber for example. The seal is advantageously an O-ring or could be flat.

When in position in the container holder system 28, the proximal end of the container 27 is inserted in the recess 31 and contacts the seal thus preventing any leak when the vacuum is pulled and covers the third opening 9 of the main body 2. The container 27 is also aligned with the third opening 9 and, as a result, with the longitudinal axis (A) of travel of the vent tube 13 and the piston rod 24.

Moreover, from a practical point of view, when the vacuum is pulled in the device 1 to a pressure $P_1$ inferior to the atmospheric pressure $P_0$, the container 27 is pulled by the vacuum forces towards the proximal direction and is, as a result, pressed against the proximal wall 29.

The lateral wall 33 is provided with a slot 34, and the distal wall 32 is provided with a through groove 35 continuous with the slot 34, said groove extending from the slot through the distal wall 32. In a practical way, the proximal end of the container 27 is inserted through the slot 34 of the lateral wall, and moved in a radial direction along the groove 35 of the distal wall until the container 27 is aligned with the third opening 9 of the main body 2. The proximal end of the container 27 is then moved upwards against the seal located into the recess 31.

The groove 35 is configured to allow insertion of the container 27 while avoiding said container to fall off the device 1. To this end, the width of the groove 35 is advantageously smaller than the width of the proximal end of the container 27.

The groove 35 is configured so that the inner surface of the groove contacts the body of the container 27. In particular, the groove 35 can be configured to prevent the container 27 inserted herein from moving radially, unless the container is moved by an operator. The groove is preferably made of a rigid and smooth material, such as rigid plastic or metal (aluminum, stainless steel) for example, for making the insertion of the container therein easier, as well as contributing to maintain the container in a fixed position in the housing 37 while the container is being stoppered.

To this end, the groove 35 can comprise adjustment means for adjusting the width of the groove.

For the same purpose, the structure of both the slot 34 and the groove 35 may be adapted according to the type of container intended to be stoppered by the device.

When the container 27 is a syringe or the like for example, as the width of the proximal end of the container is greater than the width of its body, the width of the slot 34 is greater than the width of the groove 35. This configuration is the one represented in the embodiment of FIGS. 3C and 4. The entrance of the groove 35 is delimited by two projecting parts 36 formed in the distal wall 32, that face the proximal wall 29. In this configuration, when inserted in the groove 35, the proximal end of the container 27 can abut the projecting parts 36 thus preventing the container 27 from falling off the groove 35.

Alternatively, when the container 27 is a cylinder or the like, as the width of the cylinder is the same all along its length, the width of the slot 34 can be the same as the width of the groove 35. In this configuration, the proximal end of the container 27 cannot abut the distal wall, but the container can still be maintained radially by the groove 35 if said groove is configured to prevent the container 27 inserted herein from moving radially and as described previously.

The seal can be adapted according to the type of container as well. For example, when the container is a syringe or the like, the seal can be a flat seal, whereas when the container is a cylinder, the seal can be an o-ring seal.

Contrary to prior art vacuum and vent tube stoppering apparatuses that do not comprise any container holder system (the container being merely placed in alignment with the vent tube), the container holder system of the device according to the invention is attached to the body; thus, the container is fixed to the main body during use. This contributes, along with the general structure of the device having reduced dimensions and weight, to make the device handheld and easy to carry for use, especially for performing quick and simple implementation of vacuum stoppering of a medical container 27. Besides, the device can be easily sterilized in an autoclave.

The device 1 is handheld, which means it can be carried in one hand of a user during use and transport from one location to another. The dimensions and weight of the device are advantageously adapted for this purpose. For example, the main body 2 preferably has a length comprised between 20 centimeters and 30 centimeters, a weight inferior to 1 kilogram, more preferably comprised between 50 grams and 300 grams, and a diameter comprised between 5 centimeters and 10 centimeters.

When using the device, the user can hold the main body in a substantially vertical position with one hand while mounting the medical container in the container holder system with the other hand. Then, for pulling the vacuum in the device, the user may keep gripping the main body with one hand, and pull then adjust the vacuum with the vacuum pump 39 and the vacuum valve 40 respectively with the other hand, before pushing the lid 19 of the vent device 12 and then the piston rod 24 with said other hand. If necessary, the device may of course be fixed onto an appropriate device so as to facilitate the process, such as a hanger arm for example.

Another object of the invention is a system 38 for vacuum and vent tube stoppering a medical container 27, comprising a device 1 as previously described, and a method combining vacuum and vent tube techniques for stoppering a medical container 27 using such device 1 or system 38. The method will be further explained along with the system illustrated in FIG. 5.

The system 38 comprises the device 1, a vacuum pump 39, a micrometric or any other type of vacuum valve 40, a back valve 41, a pressure probe (not represented) connected to a digital display 42, and a power source 43.

First, the stopper 26 is inserted and positioned inside the vent tube 13 under atmospheric pressure $P_0$ via the aperture 45 of the flange 17, before mounting the lid 19 and inserting the piston rod 24 in the vent tube 13.

The position of the stopper 26 in the vent tube 13 does not have to be precise, as long as the stopper is in the stroke of the piston rod 24.

The medical container 27, previously filled with a composition, is then positioned in the container holder system 28 of said device 1. At this time, the vent tube 13 is in a rest position. If not done already, the first and the second variable pressure chambers 5, 20 are connected to one or more vacuum pump(s) 39 via their outlet 6, 21. The vacuum is then pulled in both chambers until the pressure reaches a predetermined pressure $P_1$, inferior to the atmospheric pressure $P_0$. The pressure in the vent tube 13, the main body 2, and the medical container 27, is thus equal to $P_1$. The pressure is adjusted by means of the vacuum valve 40 that can be manually handled, and the pressure in the chambers 5, 20 can be checked via the digital display 42 that receives pressure measures from probes (not represented) positioned inside the chambers or in the vacuum line. The container 27 is pulled in a proximal direction against the device 1 directly by the vacuum forces or in a first step by the operator, whereas the stopper 26 remains in position in the vent tube 13.

Once the pressure read on the display 42 matches the predetermined pressure $P_1$, the vent tube 13 is pushed in a distal direction along the axis (A) to an operative position wherein the distal end of the vent tube protrudes from the distal end of the main body and enters the medical container 27.

Then, the piston rod 24 is pushed in a distal direction along the axis (A) to an operative position, thus slides inside the vent tube 13 and pushes the stopper 26 along the inner volume of the vent tube 13 further down to the inside of the container 27 until above the composition.

The position of the stopper 26 inside the container 27 does not have to be precise, as long as the stopper is not positioned too close to the proximal end of the container.

Then, breaking the vacuum by means of the back valve 41 increases the pressure inside the first and second chambers 5, 20, thus increasing the pressure in the vent tube 13, the main body 2, and the medical container 27, which causes the stopper 24 to move further down the container 27 to the surface of the composition: the container is then stoppered.

In more details, when entering the medical container 27, the stopper 26 passes from a contracted state wherein said stopper is pressed against the inner surface of the vent tube 13, to a loosened state wherein said stopper radially expands and contacts the inner surface of the medical container 27. When breaking the vacuum, the stopper 26 is moving down by itself, with no help from the piston rod 24. Indeed, the pressure in the portion of container 27 between the stopper 26 and the surface of the composition is equal to $P_1$, while the pressure in the other side of the stopper 26 is increasing. The pressure differential causes the stopper 26 to move down the container 27 until pressure equilibrium is reached, which corresponds to a position of the stopper wherein said stopper is right above the surface of the composition.

Thanks to the device, the elements of the method can be carried out manually by an operator. For example, the operator can:

1) Manually position the stopper 26 in the vent device 12 of the vacuum stoppering device 1, 2) Position the container 27 in the container holder system 28 of the vacuum stoppering device 1, and 3) Further push the vent device 12 and then the piston rod 24 in a proximal direction so as to position the vent tube 13 and then the stopper 26 inside the medical container 27.

This allows for carrying out quick and simple implementation of vacuum and vent tube stoppering of a medical container, in any kind of environmental conditions such as cleanrooms, sterile environment or uncontrolled environment and switch to one to another easily.

The invention claimed is:

1. A device for vacuum and vent tube stoppering a medical container, comprising:

a main body defining an internal volume comprising a first variable pressure chamber configured to be connected to a vacuum pump, the main body being configured to receive the proximal end of a medical container so that said medical container is in communication with the first variable pressure chamber;

a vent device comprising a vent tube moveable inside the internal volume of the main body along a longitudinal axis between a proximal rest position and a distal operative position wherein the vent tube passes through the first variable pressure chamber down to the inside of the medical container, the vent tube having an internal volume configured to contain a stopper in a compressed state, the vent tube being in communication with a second variable pressure chamber configured to be connected to the vacuum pump;

a piston rod moveable inside the internal volume of the vent tube along the longitudinal axis between a proximal rest position and a distal operative position wherein the piston rod pushes the stopper into the medical container when the vent tube is in the operative position; and a container holder system provided in the main body, in communication with the first variable pressure chamber, said container holder system being configured to receive the proximal end of a medical container to be stoppered and to hold the medical container aligned with the direction of travel of the vent tube so that when moving from the proximal rest position to the distal operative position, the vent tube enters the medical container.

2. The device according to claim 1, wherein the vent tube comprises a shoulder between a first portion moveable inside the internal volume of the main body, and a second portion configured to abut the proximal end of the main body when the vent tube is in the operative position.

3. The device according to claim 1, wherein the inner volume of the vent tube is configured to compress radially the stopper inserted herein so that the stopper has a reduced diameter compared to the diameter of the stopper when positioned inside the medical container.

4. The device according to claim 1, wherein the vent device comprises a leak tight lid from which extends the vent tube along the longitudinal axis, the leak tight lid defining an internal volume comprising the second variable pressure chamber.

5. The device according to claim 4, wherein the leak tight lid comprises an aperture on its proximal end, the aperture being aligned with the longitudinal axis and configured for receiving both the stopper and the piston rod to be inserted in the vent tube.

6. The device according to claim 1, wherein the main body comprises a first portion including a spacer configured to guide the vent tube along the longitudinal axis, and a second portion distally adjacent to the first portion, including the first variable pressure chamber.

7. The device according to claim 1, wherein the container holder system comprises:

a proximal wall provided with an opening in communication with the first variable pressure chamber, the opening being aligned with the longitudinal axis of the piston rod and configured so that, when moving, the vent tube passes through the opening, and a distal wall facing the proximal wall and joined to the proximal wall by a lateral wall provided with a slot, the distal wall being provided with a through groove continuous with the slot and extending in the distal wall from the slot, the proximal the distal wall, and the lateral wall defining a housing in between able to receive the end of the medical container inserted through the slot and moved along the groove to be aligned with the direction of travel of the vent tube.

8. The device according to claim 7, wherein the proximal wall of the medical container holder system comprises a recess provided with the opening, the recess being configured to contact the proximal end of the medical container and to block the medical container radially when the latter is positioned in the housing and when the device is under vacuum.

9. The device according to claim 1, wherein the piston rod comprises a handle configured to be moved manually by a user.

10. The device according to claim 1, wherein said device is handheld.

11. A system for vacuum and vent tube stoppering a medical container, comprising:

the device according to claim 1, a vacuum pump and a vacuum valve for pulling vacuum and adjusting the pressure in the first and second variable pressure chambers of the device to a pressure inferior to the atmospheric pressure, and a back valve for breaking vacuum so as to adjust the pressure in the first and second variable pressure chambers back to the atmospheric pressure.

12. The system according to claim 11, further comprising a digital display associated with a probe positioned inside each of the first and second variable pressure chambers so as so measure and display the pressure in said first and second variable pressure chambers to a user.

13. A method for vacuum and vent tube stoppering a medical container using a device according to claim 1, comprising:

a) positioning a stopper inside the vent tube;

b) mounting a medical container pre-filled with a composition on the main body of the device;

c) pulling vacuum in the first and second variable pressure chambers so as to decrease the pressure inside the first and second variable pressure chambers and inside the vent tube;

d) moving the vent tube along the longitudinal axis through the main body when the pressure is down, up to the inside of the medical container, and moving the piston rod along the vent tube so as to push the stopper out of the vent tube and position said stopper inside the medical container; and e) breaking the vacuum so as to increase the pressure inside the first and second variable pressure chambers, causing the stopper to expand and to move further down the medical container to the surface of the composition contained herein due to pressure differential between the first and second variable pressure chambers and the remaining volume between the stopper and the composition.

14. The method according to claim 13, wherein the device held in a user's hand, and at least elements a), b), and d) are carried out manually by the user.

* * * * *